US006393855B1

(12) United States Patent
Schuchert et al.

(10) Patent No.: US 6,393,855 B1
(45) Date of Patent: May 28, 2002

(54) METHODS AND DEVICES FOR RETAINING A HEATING ELEMENT WITHIN A REFRIGERATION CABINET

(75) Inventors: Bart Schuchert; Gene Schuchert, both of Iowa City; David Olberding, Cedar Rapids; Ron Haltmeyer, Solon; Forrest Wing, Des Moines, all of IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/841,397

(22) Filed: Apr. 24, 2001

(51) Int. Cl.[7] ..... F25B 47/00

(52) U.S. Cl. ..... 62/277; 62/275; 62/453; 62/451

(58) Field of Search ..... 62/275, 277, 453, 62/451

(56) References Cited

U.S. PATENT DOCUMENTS

| | | | | | |
|---|---|---|---|---|---|
| 2,585,043 | A | | 2/1952 | Sandberg | |
| 2,660,412 | A | | 11/1953 | Sandberg | |
| 2,806,360 | A | | 9/1957 | Armentrout | |
| 2,856,163 | A | | 10/1958 | Bidak et al. | |
| 3,580,004 | A | * | 5/1971 | Kogel et al. | 62/148 |
| 3,835,660 | A | | 9/1974 | Franck | |
| 4,002,199 | A | * | 1/1977 | Jacobs | 165/61 |
| 4,142,092 | A | * | 2/1979 | Abrams | 219/218 |
| 4,341,089 | A | * | 7/1982 | Ibrahim et al. | 62/246 |
| 4,735,062 | A | | 4/1988 | Woolley et al. | |
| 4,881,315 | A | | 11/1989 | Powell et al. | |
| 4,903,858 | A | | 2/1990 | Clark et al. | |
| 5,255,531 | A | | 10/1993 | Williams et al. | |
| 5,725,294 | A | * | 3/1998 | Froelicher | 312/401 |
| 6,301,913 | B1 | * | 10/2001 | Schulak et al. | 62/248 |

* cited by examiner

*Primary Examiner*—William Doerrler
*Assistant Examiner*—Mark S. Shulman
(74) *Attorney, Agent, or Firm*—McKee, Voorhees & Sease, P.L.

(57) ABSTRACT

Methods and devices for retaining a heating element, such as warm refrigerant tubing, within a refrigerator cabinet. Semi-spherical raised dimples are formed upon a retaining panel in a rolled triple flange. The dimples are intermittently positioned along the retaining panel and maintain the warm refrigerant tubing in intimate surface contact with the exterior surface panel of the refrigerator. The raised dimples preclude significant intimate surface contact between the retaining panel and the tubing and permit insulating foam to be disposed between the two so that heat transfer is minimized. A dimpled flange arrangement is also used to retain tubing within a mullion. A sheet metal insert is also described that is formed having two retaining panels with raised dimples thereupon that maintain the tubing in intimate surface contact with the exterior surface panel that forms the facing for the mullion. Both the triple flange and the sheet metal insert are preferably formed by rollforming of sheet metal, and the dimples are formed during this process by pins on a roller that contact and deform a portion of the sheet metal. The use of dimples is also advantageous in that it provides an easily recognizable feature that can be used to secure the tubing within the refrigeration cabinet, thereby reducing the chances of mistakes made during installation of the tubing.

20 Claims, 2 Drawing Sheets

METHODS AND DEVICES FOR RETAINING A HEATING ELEMENT WITHIN A REFRIGERATION CABINET

BACKGROUND OF THE INVENTION

1. Field of the Invention

The invention relates to the structure of refrigeration cabinets as well as those devices and methods used to retain heating elements such as warm refrigerant tubing at a desired location within such cabinets.

2. Description of the Related Art

It is typical for the refrigerator and freezer compartments of refrigerators to leak small amounts of cold air around and through the gasket seals for the doors. When this leakage occurs, condensation or "sweating" results on the cabinet surface near the seals. It is desirable to prevent or reduce this condensation as much as possible, and various solutions have been employed to do so. For example, small heating units have been disposed inside the refrigerator cabinets and can be selectively actuated to evaporate the condensation. Unfortunately, this solution reduces the efficiency of the refrigerator since extra energy is required to operate the heating units. An alternative solution is that of running the tubing that carries warm refrigerant fluid (sometimes referred to as the post condenser loop or "PC loop") within the cabinet near the areas where condensation tends to collect. The heat from the refrigerant fluid evaporates the condensation without decreasing the efficiency of the refrigerator.

One area in which improvement is desired is that of properly retaining the heating element (most typically the post condenser loop) in place at the front portions of the refrigerator cabinet. Oftentimes, separate connectors or fasteners are used. An example of this method of retaining the heating element is found in U.S. Pat. No. 4,881,315 issued to Powell et al. Powell describes clip-type retainer members that are removably affixed to portions of the refrigerator wrapper. However, the use of additional connectors or components to retain the heating element is undesirable as the part count required to assemble the refrigerator is increased and, thus, production costs are increased as well.

In many conventional refrigerator designs, the refrigerator's exterior wrapper is joined to the interior plastic liner using a U-shaped channel (also called a triple-flange) that is rolled behind the front face panel of the wrapper. An end piece of the plastic liner is inserted into the U-shaped channel. PC loop tubing was routed adjacent to or through the rolled channel and secured therein only by the insertion of the liner. Conductive contact between the tubing and the front panel of the wrapper is not guaranteed, and without such conductive contact, heat from the PC loop can be undesirably transmitted into the refrigerated compartments of the refrigerator. In designs where the tubing has been routed adjacent the rolled channel, the position of the tubing is controlled by the geometry of the rolled form. An example of this type of arrangement is found in U.S. Pat. No. 5,255,531 issued to Williams et al. which teaches a clamping technique for retaining a hot gas tube in contact with the front wall rear surface of a refrigeration cabinet. The rolled geometry can positively position the tubing, but it also provides a path for heat to be transmitted back toward the interior compartments of the refrigerator. This is undesirable since the transmitted heat can reduce the effectiveness of cooling the interior compartments.

It would be desirable to have devices and methods that address the problems of the prior art.

SUMMARY OF THE INVENTION

The invention describes methods and devices for retaining warm refrigerant tubing within a refrigerator wrapper. Semi-spherical raised dimples are formed upon a gripping panel in a rolled triple flange. The dimples are intermittently positioned along the retaining panel and maintain the warm refrigerant tubing in intimate surface contact with the exterior surface panel of the refrigerator. The raised dimples preclude significant intimate surface contact between the retaining panel and the tubing and permit insulating foam to be disposed between the two so that heat recirculation to the interior of the refrigerator is minimized.

A dimpled flange arrangement is also used to retain tubing within a mullion that separates the freezer of the refrigerator from the fresh food compartment. In a preferred embodiment, a sheet metal insert is formed having two retaining panels with raised dimples thereupon that maintain the tubing in intimate surface contact with the exterior surface panel that forms the facing for the mullion.

Both the triple flange and the sheet metal insert are preferably formed by rollforming of sheet metal, and the dimples are formed during this process by pins on a roller that contact and deform a portion of the sheet metal. The use of dimples is also advantageous in that it provides an easily recognizable feature that can be used to secure the tubing within the refrigeration cabinet, thereby reducing the chances of mistakes made during installation of the tubing.

DETAILED DESCRIPTION OF THE PREFERRED EMBODIMENTS

Figure 1:
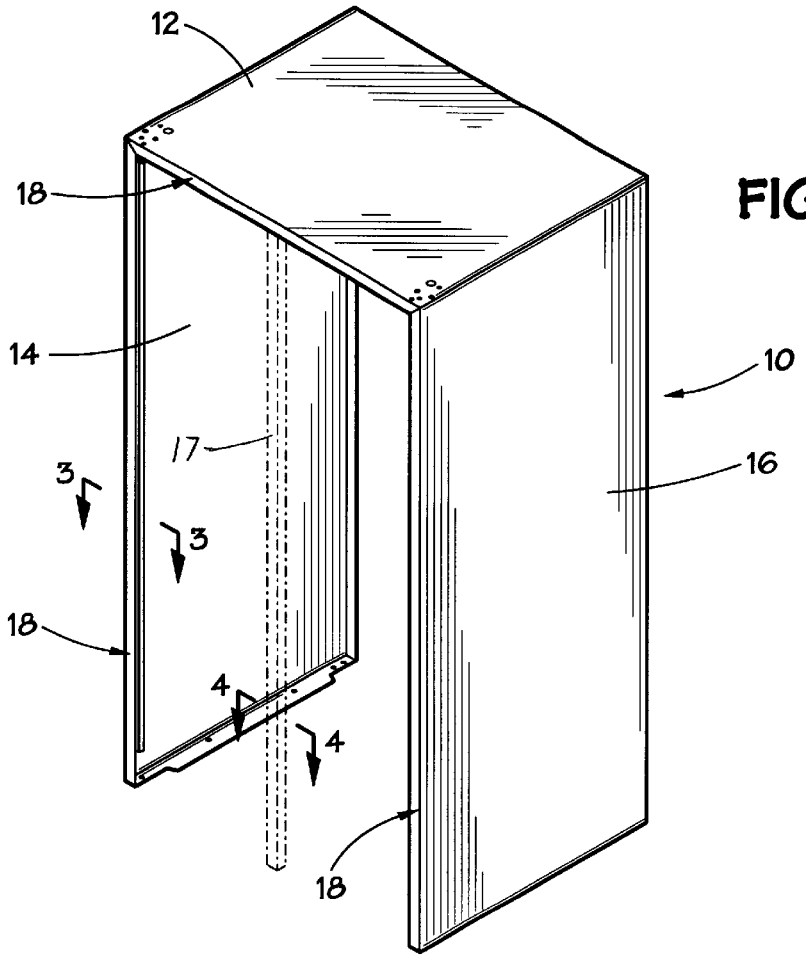
FIG. 1 is an isometric view of a refrigerator wrapper.

FIG. 1 depicts an exemplary rolled sheet metal refrigerator wrapper 10 having a top surface 12 and two depending side walls 14, 16. Also visible in FIG. 1 is the central vertical mullion 17 of the refrigerator indicating a side-by-side type of refrigerator. It should be understood, however, that the invention also has applicability to other refrigerator styles, including those where the refrigerator and freezer compartments are arranged one atop the other. The wrapper 10 is used as the outer shell of a refrigerator cabinet. The forward edges of the top panel 12 and side walls 14, 16 of the wrapper 10 each present a triple flange portion 18, so referred to because the feature includes three flanges, or panels, that lie parallel to one another at an approximate right angle to the side walls 14, 16 and top panel 12. The triple flange portion 18 is also typically used as a sealing surface against which sealing gaskets associated with the refrigerator door or doors will seal when the door(s) is/are closed against the refrigerator cabinet. The triple flange portion 18 also is used to receive therein portions of the plastic interior lining (not shown) that defines the refrigerated compartments within the refrigerator. During assembly of the refrigerator cabinet, the plastic interior lining is mated to the wrapper and then insulating foam is disposed in the areas between the two.

Figure 3:
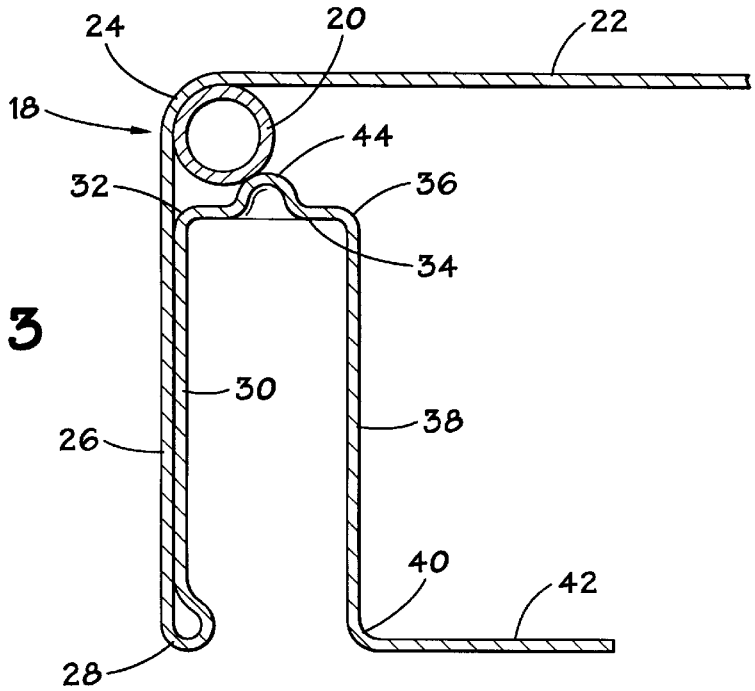
FIG. 3 is across-sectional cut-away view of a portion of the refrigerator wrapper taken along the lines 3—3 in FIG. 1.
Figure 2:
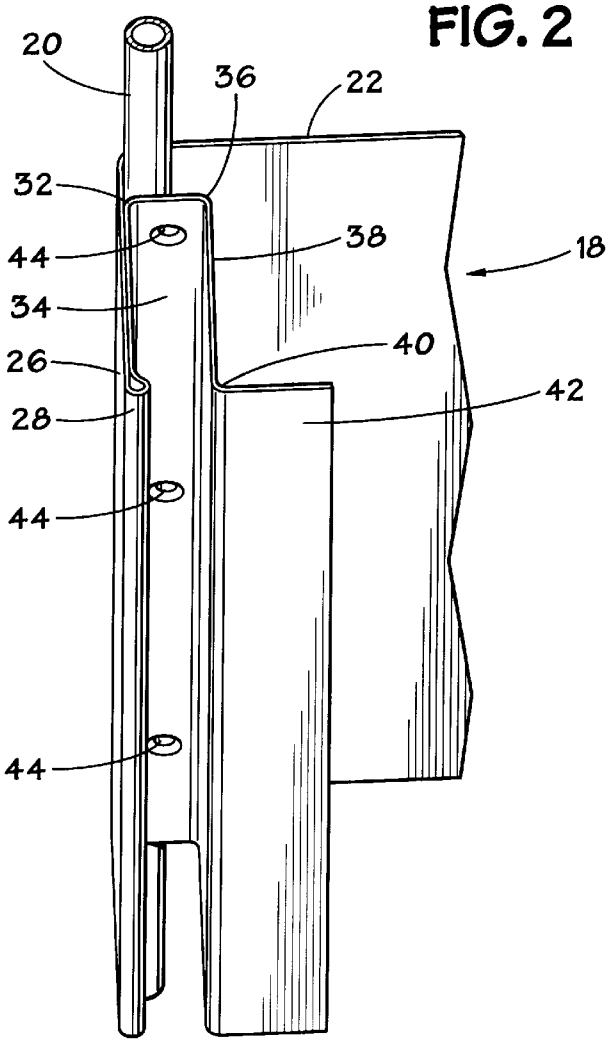
FIG. 2 is a close-up isometric view of a tube retainer constructed in accordance with the present invention.

The structure of an exemplary triple flange portion 18 may be understood in greater detail with reference to FIGS. 2 and 3. The triple flange 18 is formed of bent sheet metal and retains a tubing 20 that carries warm refrigerant fluid. The tubing 20 shown is a portion of the post condenser loop for the refrigeration system, the structure and operation of which are well understood. Typically, the tubing 20 is a 3/16" or 5/32" diameter conduit formed of copper or steel and is, therefore, non-flexible and substantially rigid while still being easily bent and formed to fit within the wrapper 10.

The triple flange 18 includes an outer lateral panel 22 that corresponds to the lateral outside panel, or side wall 14 of the refrigerator wrapper 10. The sheet metal forming the triple flange 18 is bent at 24 to an approximate 90 degree angle in order to provide a front face panel 26 The sheet metal is then reversely bent at 28 to provide a backing panel 30 that lies parallel with and adjoins the front face panel 26. The sheet metal of the triple flange 18 is then bent at 32 to provide a lateral retaining panel 34 and again reversely bent at 36 to form rear panel 38 which lies parallel to the front face panel 26 and backing panel 30. Finally, the sheet metal is bent at an approximate right angle at 40 to form flange 42. Insulation (not shown) is typically foamed in behind the rear panel 38.

The retaining panel 34 has a plurality of intermittently spaced raised dimples 44. The dimples 44 are semispherical in shape and project outwardly from the retaining panel 34 toward the outer lateral panel 22. The dimples 44 are intermittently spaced at regular intervals along the retaining panel 34. Currently preferred dimples 44 have an outside diameter spherical radius of at least 0.060"(60/1000ths of an inch). This size of dimple has been found suitable for retaining copper conduit type tubing in intimate surface contact with a desired surface as the dimple is large enough to substantially preclude contact between the tubing 20 and the retaining panel 34. A currently preferred spacing between the dimples 44 along the retaining panel 34 is approximately 3 inches. This spacing has been found sufficient to retain the tubing 20 sufficiently along its length. A lesser spacing would result in a greater number of dimples 44, thereby increasing the number of points through which heat may flow from the tubing 20 back into the retaining panel 34. A greater spacing, however, may allow unsupported, or slack, portions of the tubing 20 to contact the retaining panel 34.

As best seen in FIG. 3, the dimples 44 contact the tubing 20 and maintain it in intimate surface contact with the front face panel 26 as well as the bend 24 and outer lateral panel 22. The tubing 20 is preferably retained by the dimples 44 in intimate surface contact with the front face panel 26 along substantially the entire length of the front face panel 26.

The dimples 44 also provide for minimal physical contact between the tubing 20 and the interior portions of the U-channel, including the retaining panel 34, rear panel 38 and flange 42. Insulating foam (not shown) flows between the tubing 20 and the retaining panel 34 and rear panel 38 further reducing heat transfer. When insulating foam is injected into the assembled refrigeration cabinet, as those of skill in the art are aware, the foam expands and flows between the inner and outer walls of the cabinet and substantially encapsulates the refrigerant tubing 20 completely with the exception of where the tubing is maintained in intimate surface contact with the front face panel 26, bend 24 and outer lateral panel 22.

The triple flange 18 is normally formed through rollforming. During rollforming, a sheet metal blank is engaged by rollers that create bends, 24, 28, 32, 36 and 40. It should be understood, however, that other suitable techniques for forming the triple flange 18 may also be used. The dimples 44 are formed during the rolling of the triple flange 18. Suitably sized and shaped pins (not shown) are fixedly disposed into the outer surface of a roller (not shown) having spacing and location suitable to form each of the dimples 44 during the rollforming process. During rollforming, the dimples 44 are formed when the pins contact the sheet metal and deform it outwardly.

Figure 4:
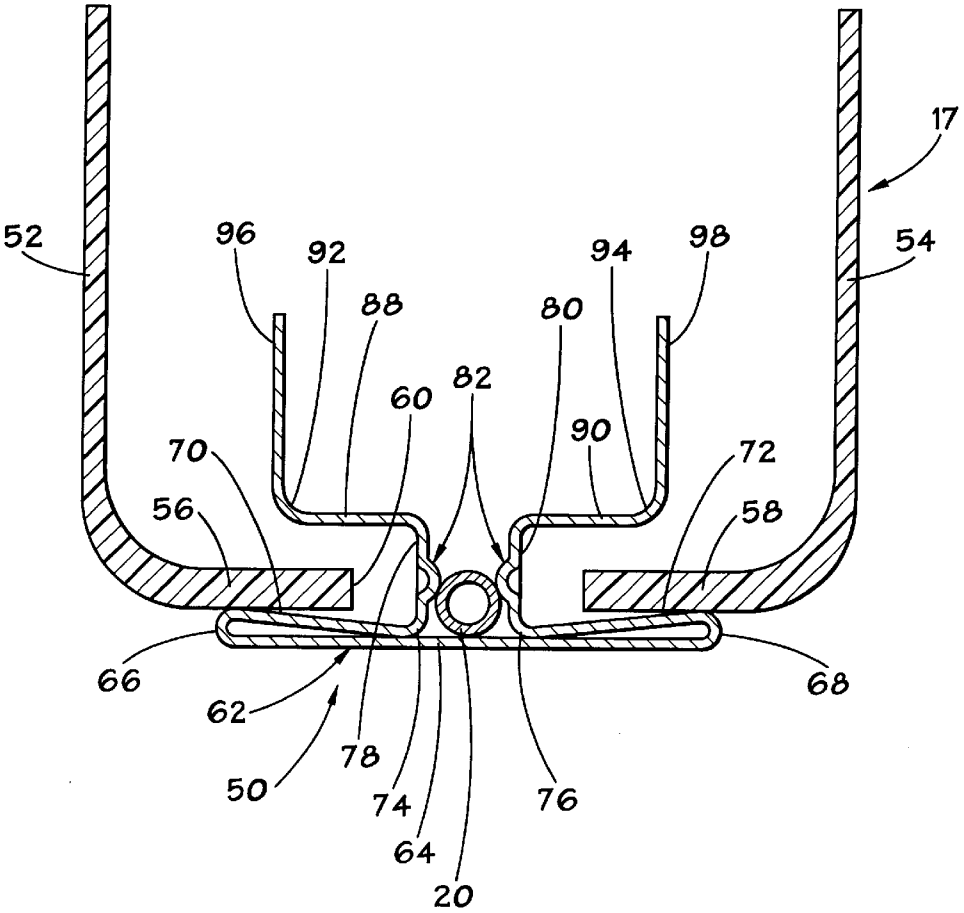
FIG. 4 is a plan cross-sectional view taken along lines 4—4 in FIG. 1 and showing a tube retainer arrangement used within a mullion within a refrigerator cabinet.

FIG. 4 illustrates an alternative tube retainer arrangement 50 wherein the refrigerant tubing 20 is retained within the vertical mullion 17 of a refrigerator. The mullion 17 includes a pair of thermoformed plastic sidewalls 52, 54 that partially define the side-by-side freezer and refrigerator compartments. The sidewalls 52, 54 are part of the interior plastic liner of the refrigerator cabinet, and in the embodiment shown, are both curved to present front side panels 56, 58. The gap 60 retains a rolled formed sheet metal insert 62 that includes a front exterior surface panel 64 that provides the exterior surface of the mullion 17. The sheet metal forming the insert 62 is bent at 66 and 68 to form contact panels 70, 72 that contact and adjoin the front side panels 56, 58, respectively, of the sidewalls 52, 54. The sheet metal is then reversely bent at 74, 76 to provide retaining panels 78, 80. The retaining panels 78, 80 lie substantially parallel to one another in a facing relationship. The retaining panels 78, 80 each have raised dimples 82 thereupon. Additionally, the sheet metal is bent at 84 and 86 to form rear panels 88, 90, which lie parallel to the front exterior surface panel 64 and bent again at 92, 94 to provide rear flanges 96, 98. The dimples 82, like dimples 44, are intermittently spaced along the retaining panels 78, 80. As can be seen in FIG. 4, the dimples 82 are positioned to mutually oppose one another. As a result, the tubing 20 is supported at a rear portion by the dimples 82 and at its front portion by the front exterior surface panel 64. The tubing 20 shown in FIG. 4 may be a second portion of the same refrigerant-carrying tubing that was used to heat the panel 26 in the triple flange 18. Alternatively, the tubing 20 shown in FIG. 4 might be another separate piece of tubing or heating element.

In operation, the dimples 82 retain the tubing 20 in intimate surface contact with the exterior surface panel 64 of the insert 62. They also minimize surface contact between rearwardly disposed portions of the insert 62 and permit insulating foam to be disposed therebetween. Therefore, heat flow to the rearward portions of the insert 62 is minimized. It is noted that the dimples 82 on each of the retaining panels 78, 80 are located in mutually opposing positions so that the tubing 20 is fully supported at its rear side by two dimples 82. A currently preferred size of the dimples 82 is, like with dimples 44, approximately 0.060 inches. Spacing between adjacent dimples 82 along the retaining panels 78, 80 is preferably about 1.5 inches. This spacing is approximately half of the spacing of the dimples 44 used in the wrapper 10, and this shorter distance has been found to be more advantageous in operation when using mutually opposing dimples to support the rear side of the tubing 20. Additionally, the insert 62 provides a savings in part count and consequent costs because the panel 64, which is to be heated, is formed into the same sheet metal insert 62 as the retaining panels 78, 80 and the dimples 82.

When the tubing 20 is installed within the triple flange 18 or within the mullion 17, it is retained in intimate surface contact with the front face panel 32 or front exterior surface panel 64, thereby providing an efficient and selective heat-conducting path to the cabinet's exterior. Transfer of heat from the tubing 20 inwardly toward the refrigerated interior enclosures is minimized. Point contacts between the dimples 44 and the tubing 20 minimizes the amount of heat that is transmitted inwardly. Foamed-in insulation fills in behind the tubing to reduce transmission of heat inwardly.

The specification has described the retaining of a heating element in intimate surface contact with two particular panels or surfaces to be heated, surface 26 and panel 64 of a refrigerator cabinet. However, it should be understood that the teachings of the invention may be applied to the retaining of heating elements against other surfaces and panels as well. Additionally, it should be understood that the nature of the particular heating element may be altered.

The use of intermittent dimples is advantageous as well from the stand point of assembly of the refrigerator. Mistakes made in initially disposing the tubing within the refrigerator cabinet are difficult and expensive to correct.

While the invention has been shown in only some of its forms, it should be apparent to those skilled in the art that it is not so limited, but is susceptible to various changes without departing from the scope of the invention.

What is claimed is:

1. A heating element retainer for a refrigerator cabinet comprising:

a surface panel to be heated;

a retaining panel positioned to lie proximate to, but not in substantial contact with, a heating element to be retained;

a raised dimple protruding from the retaining panel to contact a heating element and retain the heating element in intimate surface contact with the surface panel.

2. The heating element retainer of claim 1 wherein there are a plurality of raised dimples that are intermittently spaced at regular intervals along the retaining panel.

3. The heating element retainer of claim 1 wherein the dimple is semispherical in shape.

4. The heating element retainer of claim 1 wherein the surface panel to be heated comprises an exterior surface panel of a mullion in a refrigerator cabinet.

5. The heating element retainer of claim 4 wherein the exterior surface panel is a portion of a sheet metal insert to be located within the mullion.

6. The heating element retainer of claim 1 wherein the surface panel to be heated comprises a portion of a refrigerator wrapper.

7. The heating element retainer of claim 3 wherein the dimple has an outside diameter spherical radius of approximately 0.060 inches.

8. The heating element retainer of claim 2 wherein the dimples are spaced apart at an interval of approximately 3 inches.

9. The heating element retainer of claim 2 wherein the dimples are spaced apart at an interval of approximately 1.5 inches.

10. A refrigerator cabinet comprising:

an interior lining that defines at least one refrigerated compartment;

an outer wrapper that forms a portion of the exterior surface of the refrigerator cabinet, the outer wrapper having a panel to be heated to reduce condensation;

a heating element disposed in intimate surface contact with the panel to be heated;

a retaining panel disposed proximate but not in contact with the panel to be heated; and a set of raised dimples to contact said heating element and maintain the heating element in intimate surface contact with the panel to be heated.

11. The refrigerator cabinet of claim 10 further comprising a heating element that is retained in intimate surface contact with said panel to be heated by said set of raised dimples.

12. The refrigerator cabinet of claim 11 wherein the heating element comprises a portion of tubing for carrying refrigeration fluid.

13. The refrigerator cabinet of claim 10 wherein the panel to be heated on the outer wrapper comprises a triple flange.

14. The refrigerator cabinet of claim 11 further comprising:

a mullion separating a pair of refrigerated compartments, the mullion presenting a second panel to be heated;

a second heating element; and a second set of raised dimples contacting said second heating element to maintain it in intimate surface contact with the second panel.

15. The refrigerator cabinet of claim 14 further comprising a pair of substantially parallel and facing retaining surfaces upon which the second set of raised dimples is located.

16. The refrigerator cabinet of claim 15 wherein the second set of raised dimples comprises at least a pair of dimples located in mutually opposing positions to fully support a portion of the heating element.

17. The refrigerator cabinet of claim 14 wherein the second panel to be heated and the second set of dimples are both formed upon a single sheet metal insert that is disposed within the mullion.

18. A method of retaining a heating element in contact with a surface panel within a refrigerator cabinet comprising:

disposing a heating element in intimate surface contact with a panel to be heated in a refrigerator cabinet; and contacting the heating element with a raised dimple portion of a retaining panel to maintain the heating element in intimate surface contact with the panel to be heated.

19. The method of claim 18 wherein the step of disposing a heating element in intimate surface contact with a panel to be heated comprises disposing tubing for carrying refrigerant within a portion of a sheet metal refrigerator wrapper making up the refrigerator cabinet.

20. The method of claim 18 wherein the step of disposing a heating element in intimate surface contact with a panel to be heated comprises disposing tubing for carrying refrigerant within a portion of a plastic interior lining for the refrigerator cabinet.

* * * * *